US008342064B2

(12) United States Patent
Lin

(10) Patent No.: US 8,342,064 B2
(45) Date of Patent: Jan. 1, 2013

(54) RATCHETABLE OPEN-ENDED WRENCH

(76) Inventor: Li-Ching Lin, Chiayi County (TW)

( * ) Notice: Subject to any disclaimer, the term of this patent is extended or adjusted under 35 U.S.C. 154(b) by 150 days.

(21) Appl. No.: 12/880,173

(22) Filed: Sep. 13, 2010

(65) Prior Publication Data

US 2012/0060655 A1 Mar. 15, 2012

(51) Int. Cl.
*B25B 13/46* (2006.01)

(52) U.S. Cl. ..... 81/179; 81/186; 81/92; 81/97

(58) Field of Classification Search ..... 81/179, 81/186, 418–426.5, 92, 94, 97, 99
See application file for complete search history.

(56) References Cited

U.S. PATENT DOCUMENTS 489,822 A * 1/1893 Martin ..... 81/179
2,907,243 A * 10/1959 MacLean ..... 81/179
3,868,873 A * 3/1975 Evans ..... 81/119
6,339,978 B1 * 1/2002 Hirse ..... 81/99
7,024,971 B2 * 4/2006 Stanton ..... 81/179
7,827,887 B2 * 11/2010 Lee ..... 81/179

* cited by examiner

*Primary Examiner* — Lee D Wilson
*Assistant Examiner* — Melanie Alexander

(57) ABSTRACT

The present invention discloses a ratchetable open-ended wrench comprising wrench body and retractable jaw member. The wrench body comprises head with two opposite jaws and a receiving hole. The inner surface of the receiving hole has a sunken slot with an inner circular arc surface. The retractable jaw member is slidably mounted in the sunken slot and has two opposite sides, and one side is directing to the receiving hole and has a second engaging portion. The retractable jaw member and the head are against with an elastic member. The retractable jaw member is able to move from a first position to a second position in the sunken slot, and is able to limit a workpiece to rotate in the receiving hole when at the first position and to allow the workpiece to rotate in the receiving hole when at the second position.

5 Claims, 7 Drawing Sheets

RATCHETABLE OPEN-ENDED WRENCH

FIELD OF THE INVENTION

The present invention relates to a ratchetable open-ended wrench, particularly to an open-ended wrench whose driving head is capable of ratcheting rotation.

BACKGROUND OF THE INVENTION

Conventional ratchetable open-ended wrenches, such as U.S. Pat. No. 1,320,668, U.S. Pat. No. 7,111,529, and US Patent Application No. 20100083797, respectively mainly comprises: a wrench body and a retractable jaw member; the wrench body comprising head with two opposite jaws and a receiving hole between the two jaws; the retractable jaw member being slidably mounted on the head, the first side being directing to the receiving hole and having engaging portion; the retractable jaw member and the head being against with an elastic member; the retractable jaw member being able to move from a first position to a second position in the sunken slot, and being able to limit a workpiece rotating in the receiving hole when at the first position and allowing the workpiece to rotate in the receiving hole when at the second position.

However, the aforementioned prior arts have the following disadvantages: (a) the elastic member of the U.S. Pat. No. 1,320,668 is mounted in a cave transversely provided on the lateral side of the head; the cave is hard to be manufactured, and is exposed outside so as to decrease the pleasing to the eyes; moreover, the retractable jaw member only has one engaging surface, so that the retractable jaw member is very easy to be moved when in driving status so as to decrease the driving force; (b) the elastic member of the U.S. Pat. No. 7,111,529 is mounted in a penetrating gap provided on one jaw so as to decrease the strength of the jaw; moreover, the retractable jaw member only has one engaging surface, so that the retractable jaw member is very easy to be moved when in driving status so as to decrease the driving force; (c) the retractable jaw member of the US Patent Application No. 20100083797 only has two engaging surfaces, so that the retractable jaw member is very easy to be moved when in driving status so as to decrease the driving force; moreover, the width of the retractable jaw member is not enough, and the slot for receiving the spring is provided on the engaging portion which mainly stand the driving force, so that the strength of the retractable jaw member is decreased, and the retractable jaw member is very easy to be damaged.

SUMMARY OF THE INVENTION

The object of the present invention is to provide a ratchetable open-ended wrench comprising: a wrench body and a retractable jaw member; the wrench body comprising head with two opposite jaws and a receiving hole between the two jaws; the inner surface of the receiving hole having a sunken slot, the inner surface of the sunken slot being a circular arc surface; the retractable jaw member being slidably mounted in the sunken slot and having opposite a first side and a second side, the first side being directing to the receiving hole and having a second engaging portion; the retractable jaw member and the head being against with an elastic member; the retractable jaw member being able to move from a first position to a second position in the sunken slot, and being able to limit a workpiece to rotate in the receiving hole when at the first position and to allow the workpiece to rotate in the receiving hole when at the second position.

DETAILED DESCRIPTION OF THE PREFERRED EMBODIMENT

Figure 1:
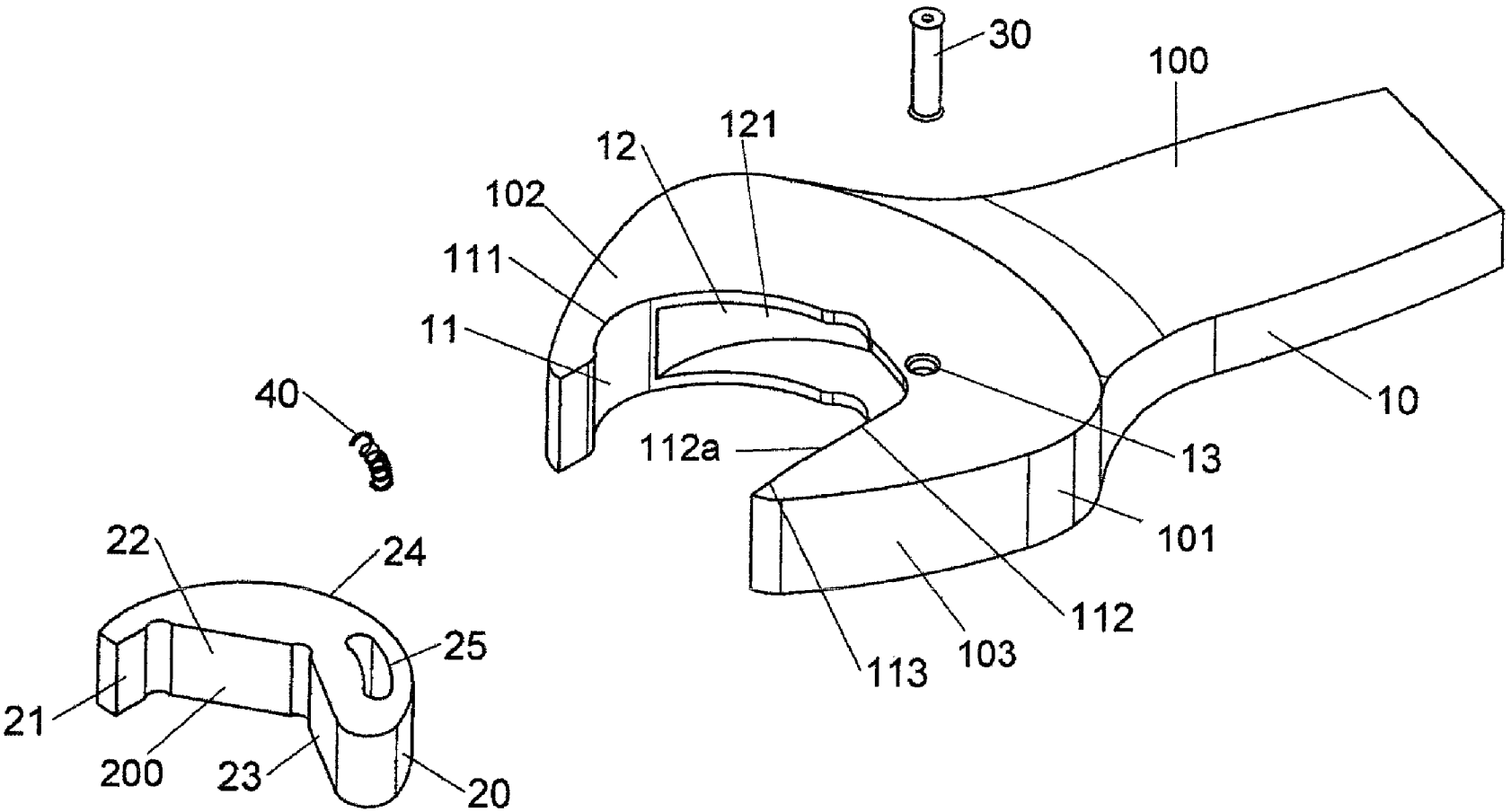
FIG. 1 is an exploded drawing of one embodiment in accordance with the present invention.

Referring to FIGS. 1 to 5, the ratchetable open-ended wrench of the present invention comprises:

a wrench body 10 comprising a handle 100, and a head 101 being formed on one end of the handle 100; the head 101 comprising opposite a first jaw 102 and a second jaw 103, and a receiving hole 11 between the two jaws 102/103; the inner surface of the first jaw 102 having a sunken curved hollow 111; the inner surface of the second jaw 103 having a first engaging portion 112; the inner surface of the receiving hole 11 having a sunken slot 12, the inner surface of the sunken slot 12 being a circular arc surface 121; and a retractable jaw member 20 being slidably mounted in the sunken slot 12 and having opposite a first side and a second side, the first side being directing to the receiving hole 11 and having a second engaging portion 200; the retractable jaw member 20 and the head 101 being connected with an elastic member 40; the retractable jaw member 20 being able to move from a first position to a second position in the sunken slot 12, and being able to limit a workpiece 50 (such as a bolt or a nut) to rotate in the receiving hole 11 when at the first position and to allow the workpiece 50 to rotate in the receiving hole 11 when at the second position; the second side of the retractable jaw member 20 being a circular surface 24.

As illustrated in FIGS. 1 to 5, the characteristic of the present invention is: the first engaging portion 112 of the second jaw 103 having a flat engaging surface 112*a*; the second engaging portion 200 of the retractable jaw member 20 having three engaging surfaces 21/22/23; the flat engaging surface 112*a* of the second jaw 103 and three engaging surfaces 21/22/23 of the retractable jaw member 20 being distributing in sequence and positioning on four sequence sides of a hexagonal column A when the retractable jaw member 20 is at the first position in the sunken slot 12.

Referring to FIG. 1, in one preferred embodiment of the present invention, there is a distance H2 between the central axis B of the circular arc surface 121 and the central axis A1 of the hexagonal column A.

Referring to FIG. 1, in one preferred embodiment of the present invention, the retractable jaw member 20 has a penetrating arc guide slot 25 which is coaxial with the circular arc surface 121, and the arc guide slot 25 extending along a circle C is positioned at the back of the engaging surface 23 which is adjacent to the flat engaging surface 112*a*; a pin 30 is fixed on the head 101 and penetrates through the sunken slot 12 and the arc guide slot 25; the elastic member 40 is a spring mounted in the arc guide slot 25, and with one end connecting with the pin 30 and the other end being against the wall of one end of the arc guide slot 25.

Figure 3:
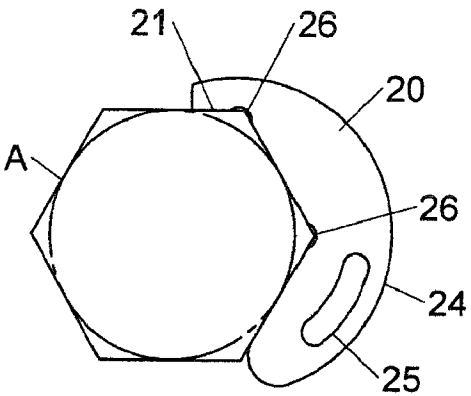
FIG. 3 is a top view of the ratchetable jaw member in accordance with the present invention.

Referring to FIG. 3, in one preferred embodiment of the present invention, each conjunction of two adjacent engaging surface 21/22/23 of the retractable jaw member 20 has a curved recess 26.

Figure 2:
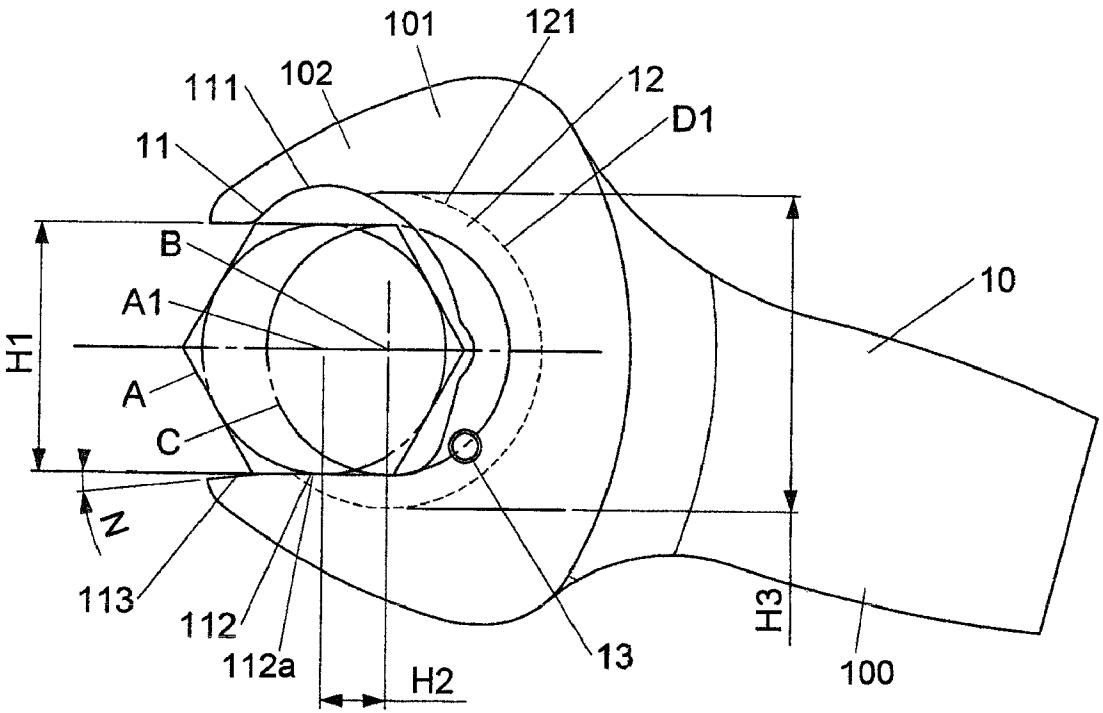
FIG. 2 is a top view of the wrench body in accordance with the present invention.

Referring to FIG. 2, in one preferred embodiment of the present invention, the ratio of the diameter H1/H3 between an inscribed circle of the hexagonal column A and the circular arc surface 121 is less than ⅓, so that the width of the retractable jaw member 20 can be fabricated as bigger as possible so as to increase its strength.

Referring to FIG. 2, in one preferred embodiment of the present invention, the distal end of the inner surface of the second jaw 103 has an inclined portion 113 with a inclined angle N following the flat engaging surface 112*a*, so as to increase the width of the gap between the two jaw 102/103 and for the easy of movement of the workpiece into the receiving hole 11.

Figure 8:
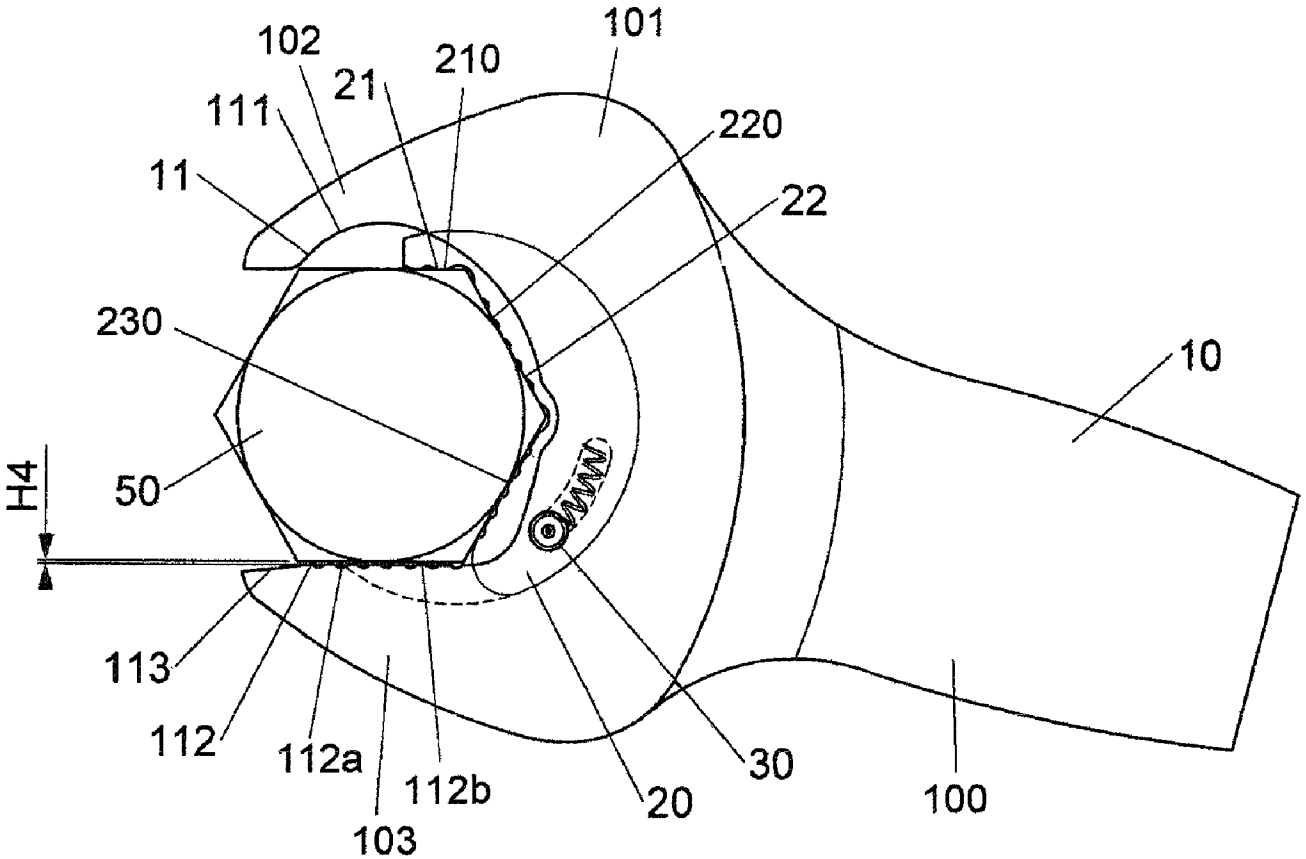
FIG. 8 is a top view of the wrench body driving the workpiece to an angle with respect to FIG. 7 in accordance with the present invention.

Referring to FIG. 8, in one preferred embodiment of the present invention, the flat engaging surface 112*a* is distributed a plurality of column flanges 112*b*. Moreover, the distance H4 between the flat engaging surface 112*a* and the workpiece 50 is matching the tolerance of rotation.

Referring to FIG. 8, in one preferred embodiment of the present invention, each engaging surface 21/22/23 of the retractable jaw member is plane and is distributed a plurality of column flanges 210/220/230.

Figure 4:
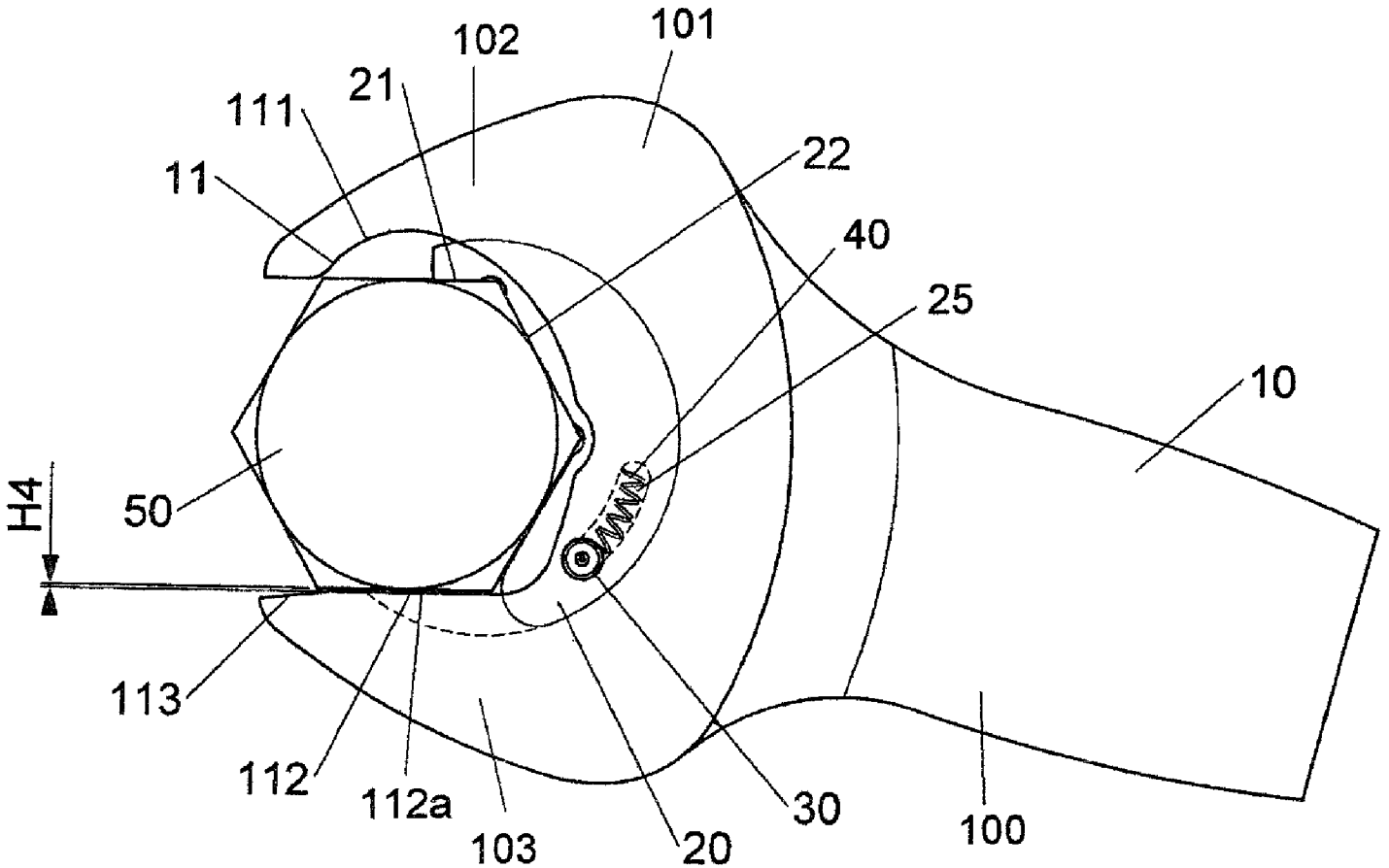
FIG. 4 is a top view of the wrench body engaging a workpiece in accordance with the present invention.

Referring to FIG. 4, the retractable jaw member 20 is at the first position in the sunken slot 12, the retractable jaw member 20 and the second jaw 103 limit the workpiece 50 to rotate in the receiving hole 11, so that the wrench can drive the workpiece 50.

Figure 5:
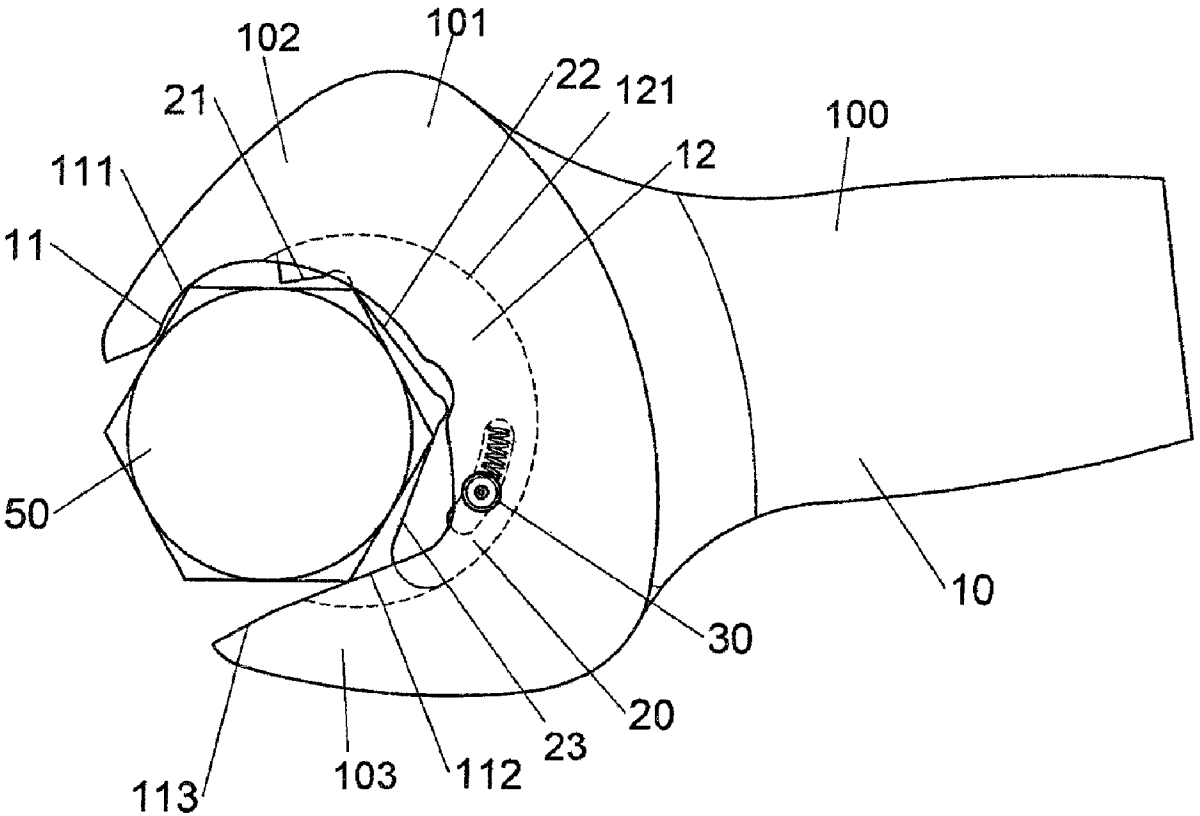
FIG. 5 is a top view of the wrench body rotating backward a little angle with respect to the workpiece in accordance with the present invention.
Figure 6:
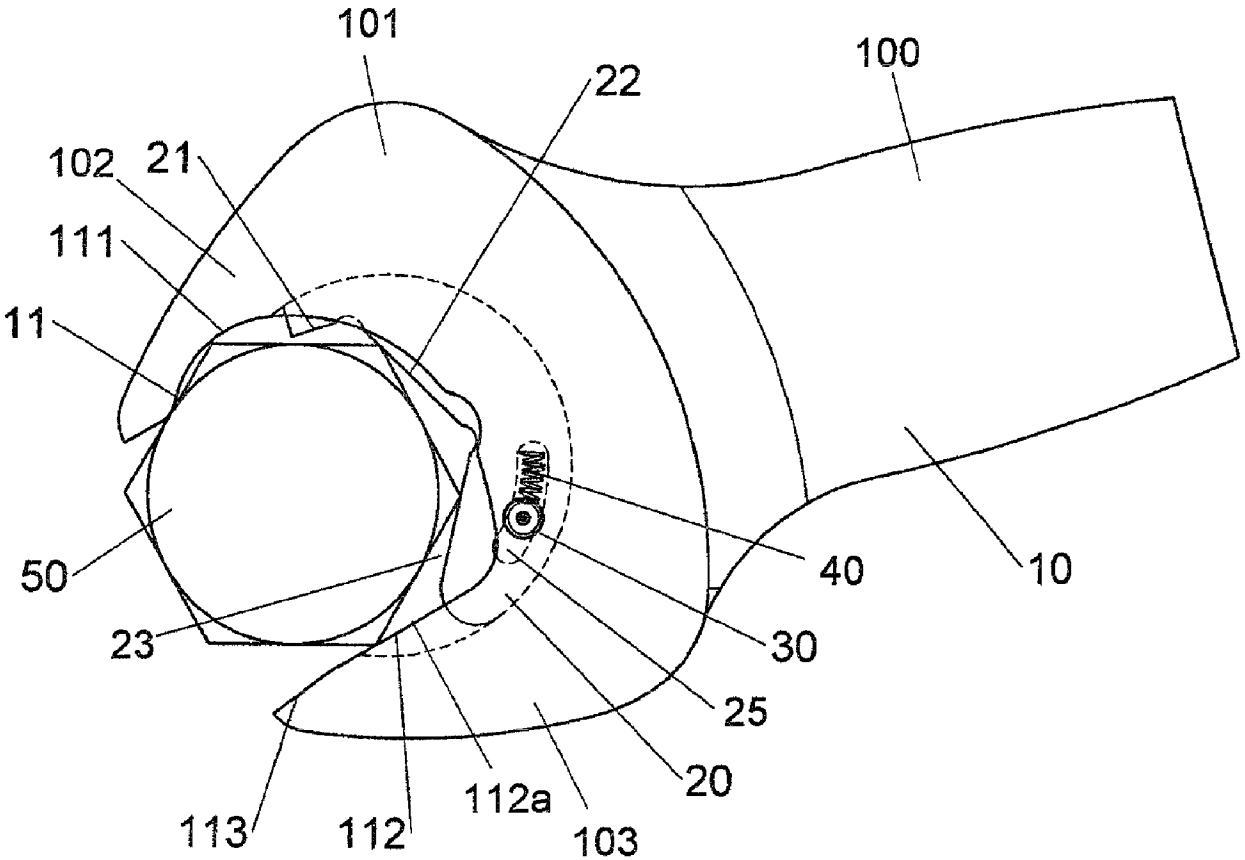
FIG. 6 is a top view of the wrench body rotating backward a bigger angle with respect to the workpiece in accordance with the present invention.
Figure 7:
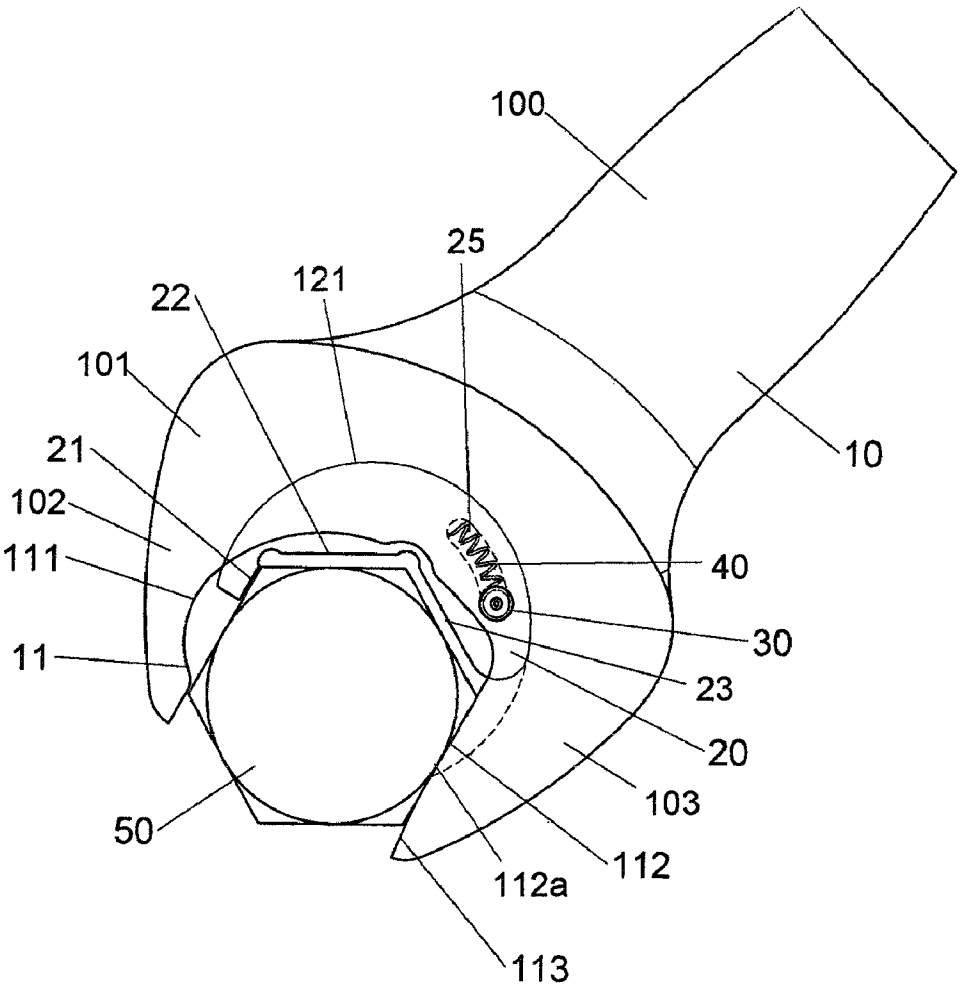
FIG. 7 is a top view of the wrench body rotating backward completely with respect to the workpiece and being ready to drive in accordance with the present invention.

Referring to FIGS. 5 and 6, when the wrench body 10 and the head 101 rotate with respect to the workpiece 50, the retractable jaw member 20 is pushed by the workpiece 50 to slide along the sunken slot 12 and to move to the second position in the sunken slot 12, so that the workpiece 50 can rotate in the receiving hole 11 with respect to the head 101. Referring to FIG. 7, when the wrench body 10 and the head 101 rotate with respect to the workpiece 50 to an angle, the retractable jaw member 20 is pushed by the elastic member 25 and return to the first position in the sunken slot 12, and the flat engaging surface 112*a* of the second jaw 103 and three engaging surfaces 21/22/23 of the retractable jaw member 20 exactly match the workpiece again, the wrench body 10 and the head 101 can drive the workpiece 50 again.

While we have shown and described the embodiment in accordance with the present invention, it should be clear to those skilled in the art that further embodiments may be made without departing from the scope of the present invention.

What is claimed is:

1. A ratchetable open-ended wrench comprising:

a wrench body comprising a handle, and a head being formed on one end of the handle; the head comprising a first jaw opposite a second jaw, and a receiving hole between the two jaws; an inner surface of the first jaw having a sunken curved hollow; an inner surface of the second jaw having a first engaging portion; an inner surface of the receiving hole having a sunken slot, an inner surface of the sunken slot being a circular arc surface;

a retractable jaw member being slidably mounted in the sunken slot and having a first side opposite a second side, the first side being directing to the receiving hole and having a second engaging portion; an elastic member being positioned between the retractable jaw member and the head; the retractable jaw member being able to move from a first position to a second position in the sunken slot, and being able to limit a workpiece to rotate in the receiving hole when at the first position and to allow the workpiece to rotate in the receiving hole when at the second position; the retractable jaw member has a penetrating arc guide slot; and a pin being fixed on the head and penetrating through the sunken slot and the arc guide slot;

wherein, the first engaging portion of the second jaw having an engaging surface; the second engaging portion of the retractable jaw member having three plane engaging surfaces; the flat engaging surface of the second jaw and three engaging surfaces of the retractable jaw member being distributing in sequence and positioning on four sequence sides of a hexagonal column when the retractable jaw member is at the first position; the penetrating arc guide slot being coaxial with the circular arc surface and being positioned at the back of one of said three engaging surfaces which is adjacent to the engaging surface of the second jaw; the elastic member being mounted in the arc guide slot with one end connecting with the pin and the other end being against one end of the arc guide slot.

2. The ratchetable open-ended wrench as claimed in claim 1, wherein there is a distance between a central axis of the circular arc surface and a central axis of the hexagonal column.

3. The ratchetable open-ended wrench as claimed in claim 1, wherein the conjunction of two adjacent engaging surface of the retractable jaw member has a curved recess.

4. The ratchetable open-ended wrench as claimed in claim 1, wherein a ratio of a diameter between an inscribed circle of the hexagonal column and the circular arc surface is less than ⅓.

5. A ratchetable open-ended wrench comprising:

a wrench body comprising a handle, and a head being formed on one end of the handle; the head comprising a first jaw opposite a second jaw, and a receiving hole between the two jaws; an inner surface of the first jaw having a sunken curved hollow; an inner surface of the second jaw having a first engaging portion; an inner surface of the receiving hole having a sunken slot, an inner surface of the sunken slot being a circular arc surface;

a retractable jaw member being slidably mounted in the sunken slot and having a first side opposite a second side, the first side being directing to the receiving hole and having a second engaging portion; an elastic member being positioned between the retractable jaw member and the head; the retractable jaw member being able to move from a first position to a second position in the sunken slot, and being able to limit a workpiece to rotate in the receiving hole when at the first position and to allow the workpiece to rotate in the receiving hole when at the second position; the retractable jaw member has a penetrating arc guide slot; and a pin being fixed on the head and penetrating through the sunken slot and the arc guide slot;

wherein, the first engaging portion of the second jaw having an engaging surface; the second engaging portion of the retractable jaw member having three plane engaging surfaces; the engaging surface of the second jaw and three engaging surfaces of the retractable jaw member being distributing in sequence and positioning on four sequence sides of a hexagonal column when the retractable jaw member is at the first position; the engaging surface of the second jaw and the engaging surface of the retractable jaw member being distributed a plurality of column flanges respectively; the penetrating arc guide slot being coaxial with the circular arc surface and being positioned at the back of one of said three engaging surfaces which is adjacent to the engaging surface of the second jaw; the elastic member being mounted in the arc guide slot with one end connecting with the pin and the other end being against one end of the arc guide slot.

* * * * *